US008740656B2

(12) United States Patent
Kotera et al.

(10) Patent No.: US 8,740,656 B2
(45) Date of Patent: Jun. 3, 2014

(54) LIGHTING APPARATUS

(75) Inventors: Ryusuke Kotera, Osaka (JP); Yoshihide Imaoka, Osaka (JP); Noboru Miyakawa, Osaka (JP); Satoshi Fukano, Nara (JP); Masashi Takeda, Osaka (JP); Akihiro Hirano, Hyogo (JP)

(73) Assignee: Panasonic Corporation, Osaka (JP)

( * ) Notice: Subject to any disclaimer, the term of this patent is extended or adjusted under 35 U.S.C. 154(b) by 99 days.

(21) Appl. No.: 13/529,318

(22) Filed: Jun. 21, 2012

(65) Prior Publication Data

US 2012/0327671 A1 Dec. 27, 2012

(30) Foreign Application Priority Data

Jun. 24, 2011 (JP) ..... 2011-140816

(51) Int. Cl.
*H01R 13/40* (2006.01)

(52) U.S. Cl.
USPC ..... 439/750

(58) Field of Classification Search
USPC ..... 439/750, 500, 568; 362/97.1, 97.2, 362/217.01, 217.02
See application file for complete search history.

(56) References Cited

U.S. PATENT DOCUMENTS

| | | | | |
|---|---|---|---|---|
| 6,364,679 | B1 * | 4/2002 | Gerstberger | 439/241 |
| 7,234,545 | B2 * | 6/2007 | Pinol et al. | 175/107 |
| 7,399,190 | B2 * | 7/2008 | Ohmori | 439/226 |
| 7,530,828 | B2 * | 5/2009 | Miyazono | 439/232 |
| 2005/0196988 | A1 * | 9/2005 | Chen | 439/115 |
| 2005/0255718 | A1 * | 11/2005 | McLeish | 439/39 |
| 2008/0037278 | A1 | 2/2008 | Chang et al. | |
| 2009/0196029 | A1 * | 8/2009 | Kurtz et al. | 362/221 |
| 2013/0033858 | A1 | 2/2013 | Sugishita et al. | |

FOREIGN PATENT DOCUMENTS

| | | |
|---|---|---|
| CN | 101122379 | 2/2008 |
| CN | 102483203 | 5/2012 |
| JP | 2009-043447 | 2/2009 |
| JP | 2010-170903 | 8/2010 |

OTHER PUBLICATIONS

China Office action, dated Jan. 6, 2014 along with an english translation thereof.

* cited by examiner

*Primary Examiner* — Tulsidas C Patel
*Assistant Examiner* — Phuongchi T Nguyen
(74) *Attorney, Agent, or Firm* — Greenblum & Bernstein, P.L.C.

(57) ABSTRACT

A lighting apparatus includes an apparatus body for supporting an LED lamp having an earth cap, an earth socket to which the earth cap of the LED lamp is mounted, and an attachment base provided in the apparatus body, the earth socket being attached to the attachment base. The earth socket includes a conductor plate for mechanically holding a lamp pin of the earth cap, the conductor plate being electrically connected to the lamp pin. The attachment base and the earth socket include a connecting unit for earth-connecting the conductor plate of the earth socket and the apparatus body.

10 Claims, 18 Drawing Sheets

LIGHTING APPARATUS

FIELD OF THE INVENTION

The present invention relates to a lighting apparatus employing a straight-tube-type LED lamp as a light source.

BACKGROUND OF THE INVENTION

In recent years, the light emission efficiency of an LED (Light Emitting Diode) grows higher, which makes it possible to use an LED with reduced power consumption and prolonged lifespan as a light source of a lighting apparatus. There is proposed a lighting apparatus that includes electrode pins having the same shape as electrode pins of a fluorescent lamp standardized by JIS Standards so that the lighting apparatus can be used without having to modify an existing fluorescent lamp fixture. The lighting apparatus is configured to be turned on as electric power is supplied through the electrode pins thereto. For example, Japanese Patent Application Publication No. 2009-43447 discloses a configuration in which an LED substrate is held within a straight outer tubular body. Two metal caps to be mounted to an existing fixture for a straight-tube-type fluorescent lamp are provided at the opposite ends of the outer tubular body.

In such a conventional LED lamp stated above, one cap serves as a power feeding cap and the other cap serves as an earth cap. In a lighting apparatus using the LED lamp as a light source, as shown in FIG. 12, a power feeding socket (not shown) for reception of the power feeding cap and an earth socket 100 for reception of the earth cap are attached to an apparatus body 101.

In this regard, the earth socket 100 is provided therein with a conductor plate 102 with which a lamp pin (not shown) of the LED lamp makes contact. The conductor plate 102 needs to be earth-connected to the apparatus body 101. The earth socket 100 has a wire insertion hole 100A into which one end of a lead wire 103 can be inserted. The conductor plate 102 is provided with a quick-connection terminal portion (not shown) to which one end of the lead wire 103 inserted into the wire insertion hole 100A is connected. A crimp-type terminal 103A to be screw-fixed to the apparatus body 101 is provided at the other end of the lead wire 103.

Description will now be made on a method of earth-connecting the conductor plate 102 of the earth socket 100 to the apparatus body 101. First, one end of the lead wire 103 is inserted into the wire insertion hole 100A of the earth socket 100 and is connected to the quick-connection terminal portion of the conductor plate 102. Then, the crimp-type terminal 103A provided at the other end of the lead wire 103 is brought into contact with one surface of the apparatus body 101 and is screw-fixed to the apparatus body 101. This makes it possible to earth-connect the conductor plate 102 of the earth socket 100 to the apparatus body 101.

In the event that the conductor plate 102 of the earth socket 100 is earth-connected to the apparatus body 101 in the manner stated above, however, it is necessary to perform a task of screw-fixing the lead wire 103 to the apparatus body 101. In this case, the following problems are posed. The crimp-type terminal 103A needs to be formed at the tip end of the lead wire 103. The loosening of a screw has to be taken into account when screw-fixing the lead wire 103. Time and effort is required in arranging the lead wire 103. The assembling work (connection work) becomes laborious and cumbersome.

SUMMARY OF THE INVENTION

In view of the above, the present invention provides a lighting apparatus capable of easily earth-connecting a conductor plate of an earth socket to an apparatus body without having to use a lead wire.

In accordance with an aspect of the present invention, there is provided a lighting apparatus including: an apparatus body for supporting an LED lamp having an earth cap; an earth socket to which the earth cap of the LED lamp is mounted; and an attachment base provided in the apparatus body, the earth socket being attached to the attachment base, wherein the earth socket includes a conductor plate for mechanically holding a lamp pin of the earth cap, the conductor plate being electrically connected to the lamp pin, and the attachment base and the earth socket include a connecting unit for earth-connecting the conductor plate of the earth socket and the apparatus body.

The connecting unit may include an insertion hole formed in the earth socket and a salient portion provided at the attachment base and inserted into the insertion hole, the salient portion making contact with the conductor plate through the insertion hole when the earth socket is attached to the attachment base.

The salient portion may be bendable.

The conductor plate may have a hole portion for reception of the salient portion, the salient portion making contact with an inner peripheral surface of the hole portion.

Erected pieces may be formed in an inner edge of the hole portion, the elected pieces protruding in a protruding direction of the salient portion while being inclined toward the salient portion inserted into the hole portion.

The connecting unit may include a connecting member attached to the earth socket and the attachment base and electrically connected to the conductor plate of the earth socket and the attachment base.

The earth socket may include an insertion hole, the conductor plate including a terminal portion of a quick-connection terminal structure arranged to correspond to the insertion hole, the connecting member including an insertion piece inserted into the insertion hole, the insertion piece being mechanically held by the terminal portion and electrically connected to the terminal portion.

The connecting member may include an insertion slot into which the attachment base is partially inserted, and a portion of the attachment base may make contact with an inner edge of the insertion slot.

In accordance with the lighting apparatus, the conductor plate of the earth socket can be easily earth-connected to the apparatus body without having to use a lead wire.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

First Embodiment

Figure 1A:
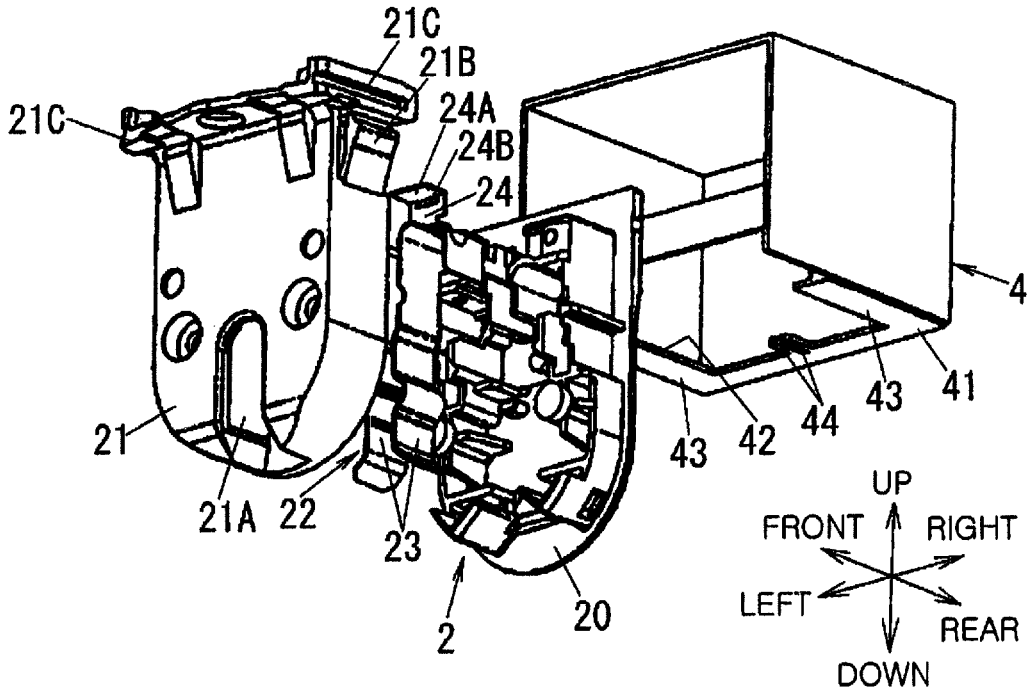
FIGS. 1A and 1B are exploded perspective views showing certain major portions of a lighting apparatus according to a first embodiment of the present invention.

A lighting apparatus according to a first embodiment of the present invention will now be described with reference to the accompanying drawings. In the following description, the up-down direction, the left-right direction and the front-rear direction will be defined by arrows shown in FIG. 1A. As shown in FIGS. 1A, 1B, 2A and 2B, the lighting apparatus of the present embodiment includes an earth socket 2 and a power feeding socket 3 to which a straight-tube-type LED lamp 1 is mounted. The lighting apparatus further includes an apparatus body 4 for supporting the LED lamp 1. The earth socket 2 and the power feeding socket 3 are attached to the apparatus body 4. The earth socket 2 is well-known in the art and no description will be made on the portions of the earth socket 2 having nothing to do with the present invention. The power feeding socket 3 has the same structure as the earth socket 2 except that an insertion hole 20A to be described later is not provided in the power feeding socket 3 and that a protrusion 24A and a hole portion 24B of a connecting piece 24 to be described later are not formed in the power feeding socket 3. No description will be made on the power feeding socket 3.

Figure 2A:
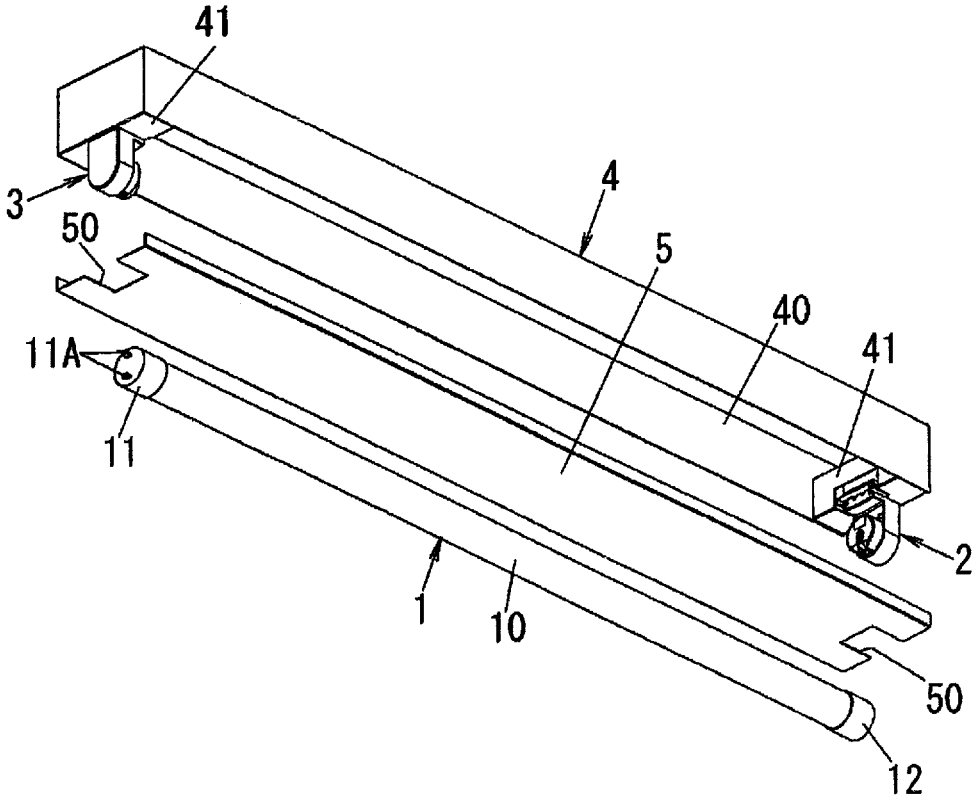
FIG. 2A is an exploded perspective view of the lighting apparatus and FIG. 2B is an overall perspective view of the lighting apparatus.
Figure 2B:
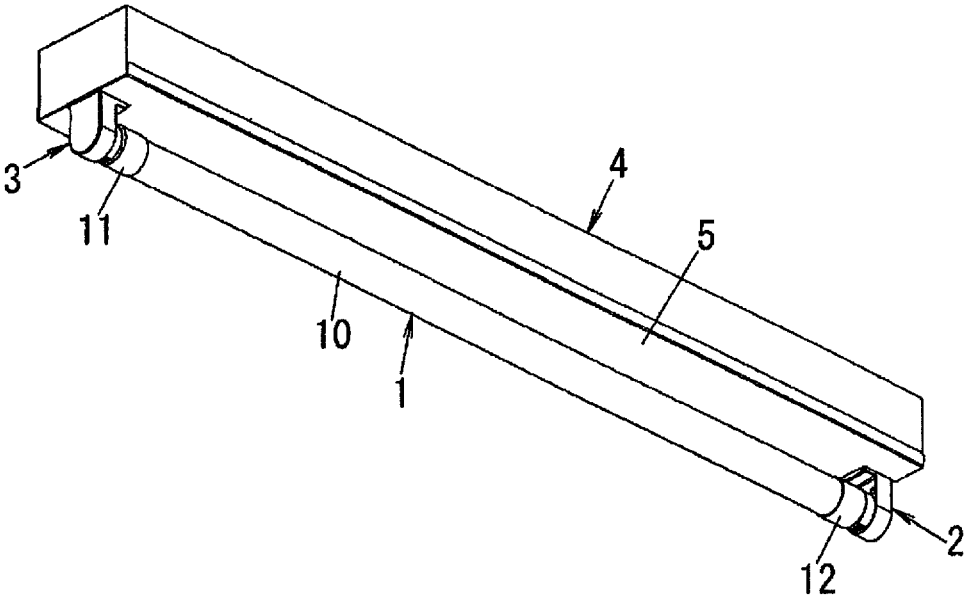

As shown in FIGS. 2A and 2B, the LED lamp 1 includes a straight-tube-type lamp body 10, a power feeding cap 11 and an earth cap 12. The power feeding cap 11 and the earth cap 12 are provided at the longitudinal opposite ends of the lamp body 10. A pair of lamp pins 11A having a round bar shape protrudes from the power feeding cap 11. Similarly, a pair of lamp pins (not shown) having a round bar shape protrudes from the earth cap 12. While not shown in the drawings, a substrate carrying a plurality of LEDs is stored within the lamp body 10. The anode and cathode of each of the LEDs are electrically connected to the lamp pins 11A of the power feeding cap 11. Therefore, the LED lamp 1 can be turned on by supplying electric power to the respective LEDs through the lamp pins 11A of the power feeding cap 11.

Figure 1B:
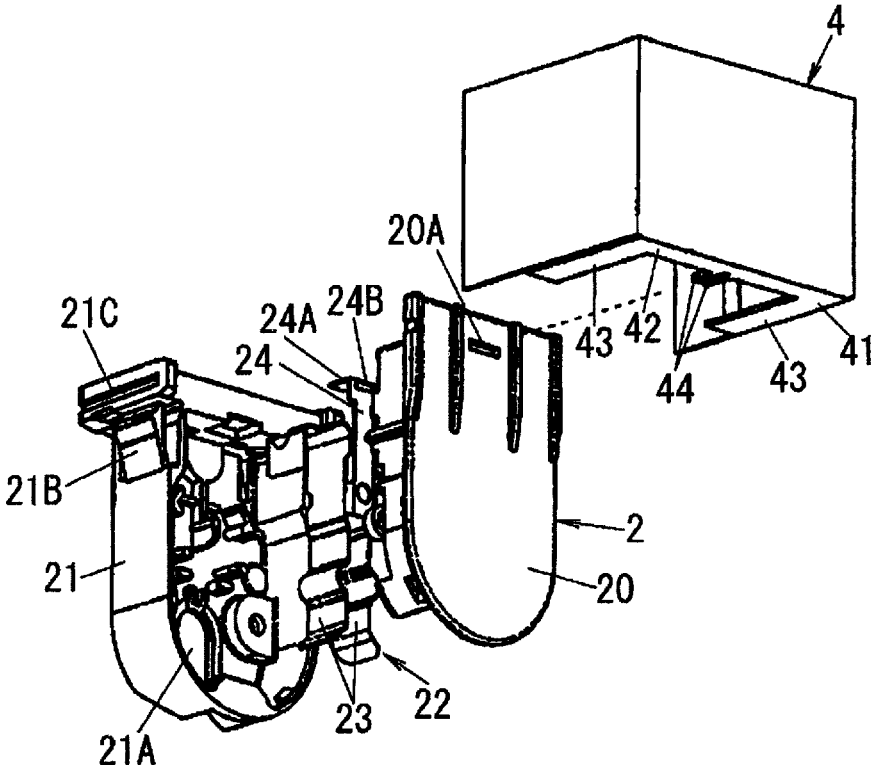

As shown in FIGS. 1A and 1B, the earth socket 2 includes a resin-made body 20 formed of a substantially U-like box and opened on the front surface thereof and a resin-made cover 21 opened on the rear surface thereof. The body 20 and the cover 21 are assembled together. A rectangular insertion hole 20A, into which a salient portion (connecting unit) of an attachment base 41 to be described later is inserted, is formed in the upper end portion of the rear surface (back surface) of the body 20. An insertion recess 21A, opened at the lower and front sides, is formed in the lower end portion of the cover 21. The lamp pin of the earth cap 12 of the LED lamp 1 can be slidably inserted into the insertion recess 21A. A conductor plate 22 for gripping and mechanically holding the lamp pin of the earth cap 12 is provided inside the insertion recess 21A. The conductor plate 22 is electrically connected to the lamp pin of the earth cap 12. Bendable elastic pieces 21B protruding outward in the left-right direction are provided on the upper left and right side surfaces of the cover 21. Lug portions 21C for gripping attachment pieces 43 of a below-mentioned attachment base portion 41 between itself and the elastic pieces 21B are formed on the upper left and right side surfaces of the cover 21.

Figure 4A:
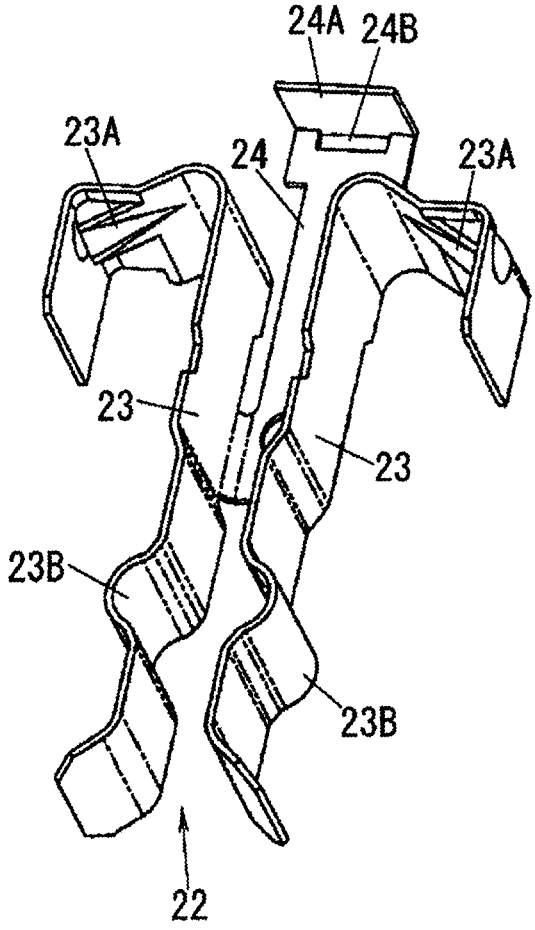
FIGS. 4A, 4B and 4C are views showing another example of the conductor plate of the lighting apparatus.

As shown in FIG. 4A, the conductor plate 22 includes a pair of left and right contact pieces 23 for gripping the lamp pin therebetween and a connecting piece 24 for interconnecting the intermediate portions of the contact pieces 23. The contact pieces 23 are formed of an elongated metal plate having elasticity. The contact pieces 23 and the connecting piece 24 are one-piece formed with each other. Terminal portions 23A, each of which has a quick connection terminal structure for connecting a lead wire, are provided in the upper end portions of the respective contact pieces 23. Since no lead wire is employed in the present embodiment, the terminal portion 23A is not used to connect one end of a lead wire. Holding portions 23B, both of which are curved outward in the left-right direction to have an arc-like cross-sectional shape, are provided in the lower end portions of the respective contact pieces 23. By gripping the lamp pin between the holding portions 23B, the lamp pin is mechanically held by the conductor plate 22 and is electrically connected to the conductor plate 22.

Figure 3A:
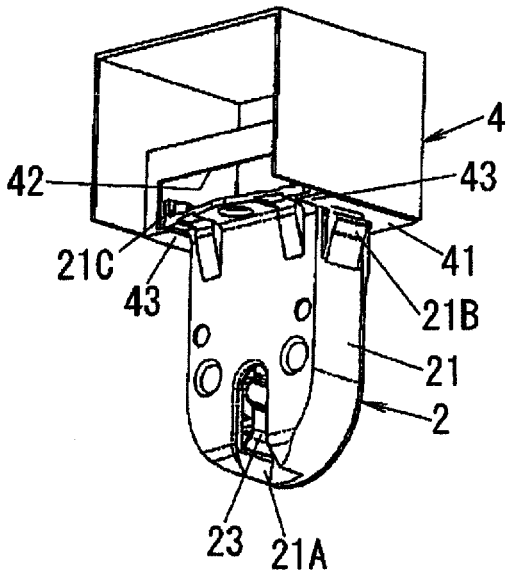
FIGS. 3A, 3B and 3C are perspective views of certain major portions of the lighting apparatus showing an earth socket attached to an apparatus body.
Figure 3B:
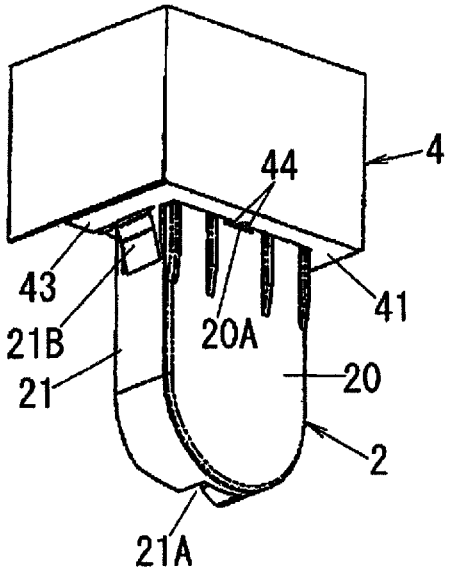
Figure 3C:
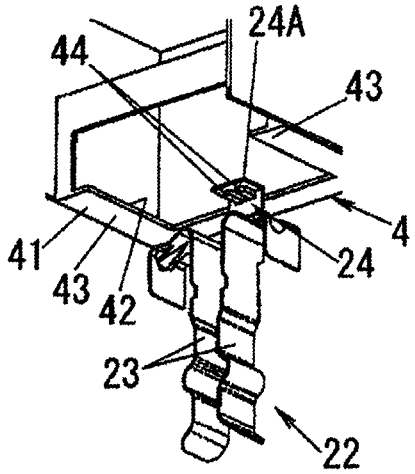

Just like the contact pieces 23, the connecting piece 24 is formed into an elongated rectangular plate shape to extend along the up-down direction. A rectangular protrusion 24A bent forward is provided in the upper end portion of the connecting piece 24. A rectangular hole portion 24B, into which the salient portion 44 of the attachment base 41 to be described later is inserted, is formed in the upper end portion of the connecting piece 24. The up-down dimension of the hole portion 24B is set a little smaller than the up-down thickness of the salient portion 44. The left-right dimension of the hole portion 24B is set a little smaller than the left-right dimension of the salient portion 44. Accordingly, if the salient portion 44 is forcibly inserted into the hole portion 24B, the inner periphery of the hole portion 24B and the outer peripheral surface of the salient portion 44 make contact with each other. The upper surface of the salient portion 44 inserted into the hole portion 24B makes contact with the lower surface of the protrusion 24A (see FIG. 3C).

As shown in FIGS. 2A and 2B, the apparatus body 4 is made of a metal plate and is formed into an elongated box shape to extend in the front-rear direction. Attachment bases 41 for attachment of the earth socket 2 and the power feeding socket 3 are provided in the front and rear end portions of the apparatus body 4. An opening 40 is formed in the region of the lower surface of the apparatus body 4 excluding the attachment bases 41. The opening 40 is closed by an elongated rectangular lid 5 extending in the front-rear direction. Rectangular cutouts 50 for circumventing the earth socket 2 and the power feeding socket 3 are formed in the front and rear end portions of the lid 5.

While not shown in the drawings, a lighting unit for supplying lighting power to the LED lamp 1 is provided within the apparatus body 4. The lighting unit and the power feeding socket 3 are electrically connected to each other by, e.g., lead wires (not shown). Accordingly, the LED lamp 1 mounted to the power feeding socket 3 is turned on by the lighting power supplied from the lighting unit. The lighting unit is well-known in the art and therefore will not be described herein.

As shown in FIGS. 1A and 1B, the attachment base 41 is formed into a box shape by bending a metal plate making up the apparatus body 4. For the purpose of attaching each of the sockets 2 and 3, the front surface and a portion of the lower surface are cut into a rectangular shape. Rectangular attachment pieces 43 protruding toward each other (inward) are one-piece formed in the left and right sides of the inner edge of the cutout (hereinafter referred to as "attachment opening 42") on the lower surface of the attachment base 41. The attachment pieces 43 are gripped by the elastic pieces 21B and the lug portions 21C of the earth socket 2, whereby the earth socket 2 is attached to the attachment base 41. While not shown in the drawings, the power feeding socket 3 is attached to the attachment base 41 in the same manner as set forth above.

The salient portion 44 made up of a pair of forwardly-protruding projections is one-piece formed in the rear side of the inner edge of the attachment opening 42. The salient portion 44 is provided in such a position that, when attaching the earth socket 2 to the attachment base 41, the salient portion 44 is inserted into the insertion hole 20A of the rear surface of the body 20 and the hole portion 24B of the conductor plate 22.

Description will now be made on a method of attaching the earth socket 2 to the attachment base 41 of the apparatus body 4. First, the earth socket 2 is aligned with the apparatus body 4 so that the attachment pieces 43 of the attachment base 41 can be inserted between the elastic pieces 21B and the lug portions 21C of the earth socket 2. Then, the earth socket 2 is slid backward. At this time, the salient portion 44 of the attachment base 41 is inserted into the insertion hole 20A of the body 20 of the earth socket 2 and into the hole portion 24B of the conductor plate 22 existing within the earth socket 2. The attachment pieces 43 are gripped between the elastic pieces 21B and the lug portions 21C. Thus the earth socket 2 is attached to the attachment base 41 and the salient portion 44 is brought into contact with the conductor plate 22. In other words, the conductor plate 22 of the earth socket 2 is earth-connected to the apparatus body 4 upon attaching the earth socket 2 to the attachment base 41.

In the present embodiment described above, when attaching the earth socket 2 to the attachment base 41 of the apparatus body 4, the salient portion 44 of the attachment base 41 is inserted into the insertion hole 20A of the body 20 and the hole portion 24B of the conductor plate 22, whereby the salient portion 44 makes contact with the conductor plate 22. In the present embodiment, therefore, the conductor plate 22 of the earth socket 2 can be easily earth-connected to the apparatus body 4 with no use of lead wires by merely attaching the earth socket 2 to the attachment base 41 of the apparatus body 4.

In the present embodiment, the salient portion 44 is made up of a pair of rod-shaped projections as set forth above and is therefore bendable (elastically deformable) in the left-right direction. Since the salient portion 44 is a little larger in size than the hole portion 24B, the salient portion 44 is pressed against the inner edge of the hole portion 24B when inserted into the hole portion 24B of the conductor plate 22. Accordingly, the salient portion 44 presses the inner edge of the hole portion 24B under the action of a restoring force. This assures reliable contact of the salient portion 44 with the conductor plate 22.

Figure 4B:
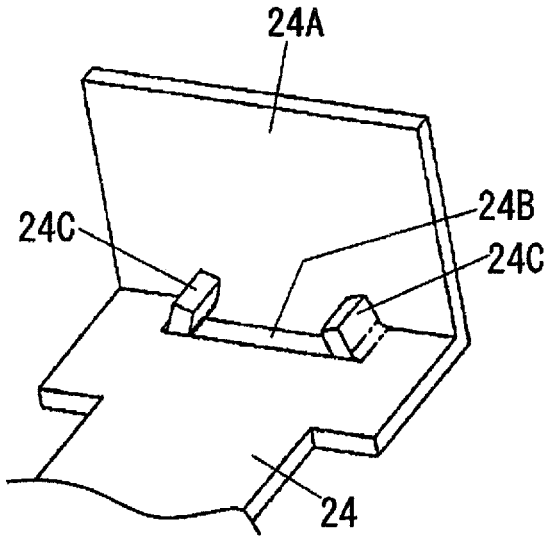
Figure 4C:
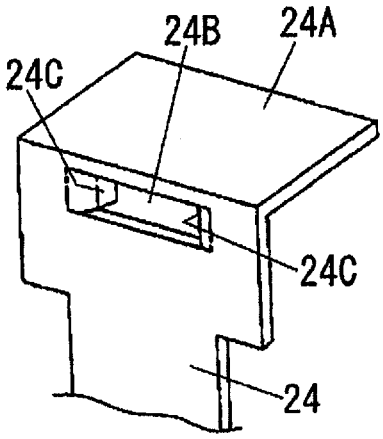

As shown in FIGS. 4B and 4C, a pair of erected pieces 24C protruding in the same direction as the protruding direction of the protrusion 24A may be formed by cutting and erecting the inner edge of the hole portion 24B of the connecting piece 24. The erected pieces 24C are inclined toward each other as they extend from the base ends to the tip ends. For that reason, the left-right distance between the tip ends of the erected pieces 24C becomes smaller than the left-right distance of the hole portion 24B. Therefore, when forcibly inserted into the hole portion 24B, the salient portion 44 is pressed by the erected pieces 24C. This makes it possible to bring the salient portion 44 into contact with the conductor plate 22 regardless of the dimensional deviation of the salient portion 44 and the hole portion 24B.

As shown in FIGS. 5 and 6, the lighting apparatus of the present embodiment may have a configuration in which a substantially rectangular hole 45 is formed in the attachment base 41 and in which the earth socket 2 is attached to the attachment base 41 in a so-called snap-in fashion by inserting the earth socket 2 into the rectangular hole 45 from above. In this configuration, the attachment base 41 includes a rectangular protrusion wall 46 protruding downward from the rear edge of the attachment base 41 and facing the rear surface of the earth socket 2 and a jut portion 47 protruding forward from the lower end of the protrusion wall 46. The protrusion wall 46 and the jut portion 47 are one-piece formed with the attachment base 41.

Figure 6A:
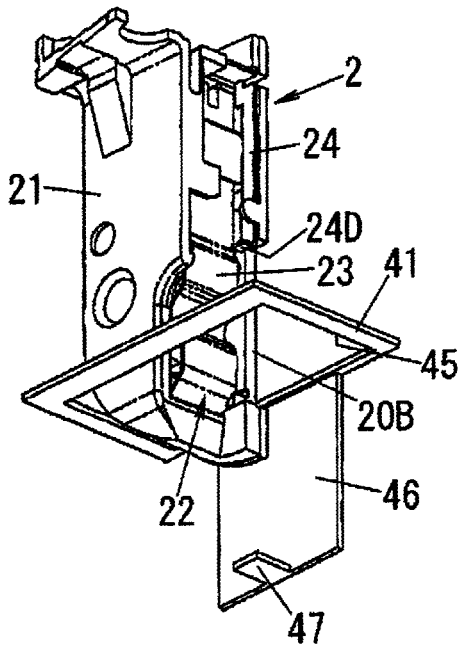
FIGS. 6A, 6B and 6C are rear perspective views of the earth socket of the lighting apparatus which is in a snap-in attachment process.

An elongated rectangular slit 20B extending in the up-down direction is formed on the rear surface of the body 20 of the earth socket 2. The jut portion 47 of the attachment base 41 is inserted into the slit 20B. As shown in FIG. 6A, a protuberance 24D protruding forward is provided in the lower end portion of the connecting piece 24 of the conductor plate 22.

Figure 5A:
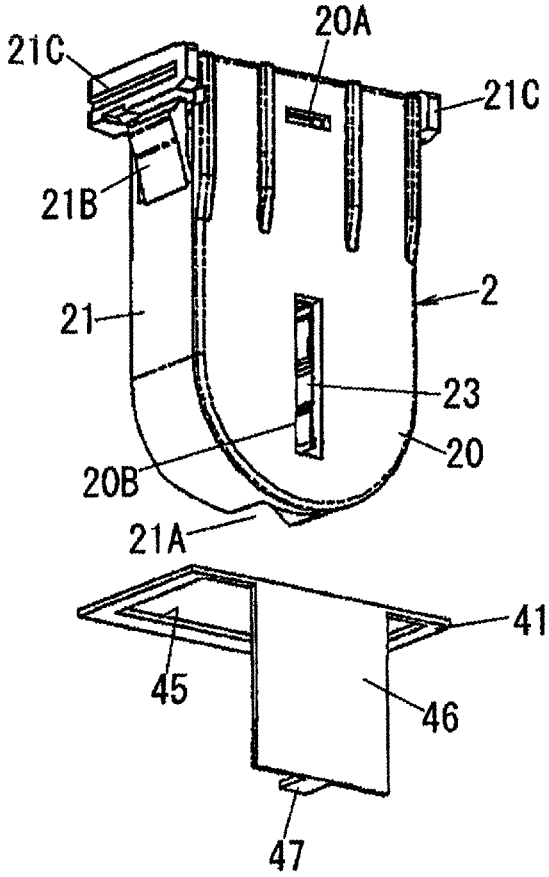
FIGS. 5A, 5B and 5C are partially-removed front perspective views of the earth socket of the lighting apparatus which is in a snap-in attachment process.
Figure 5B:
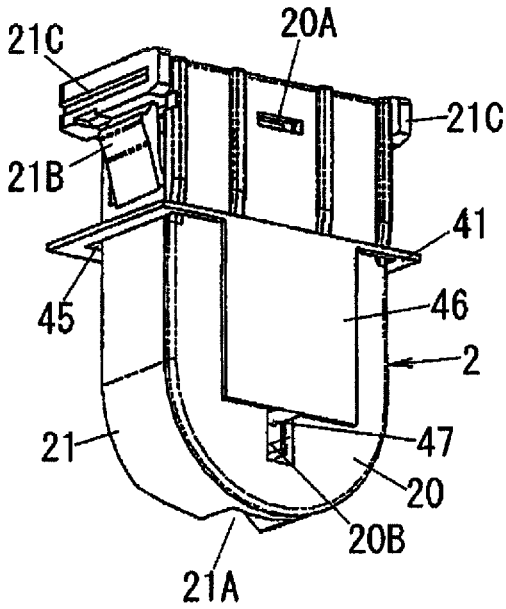
Figure 5C:
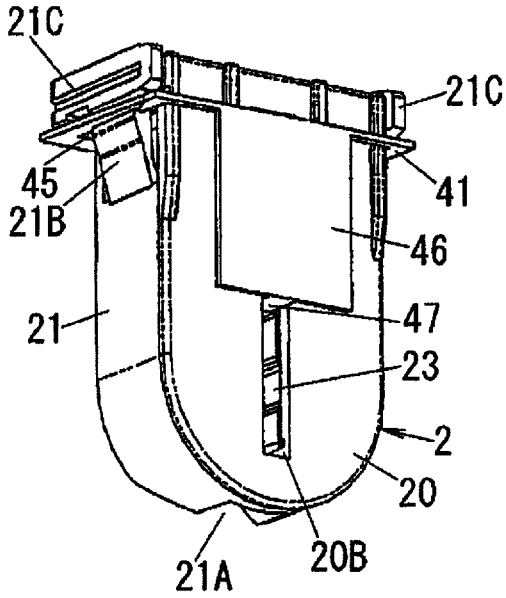
Figure 6B:
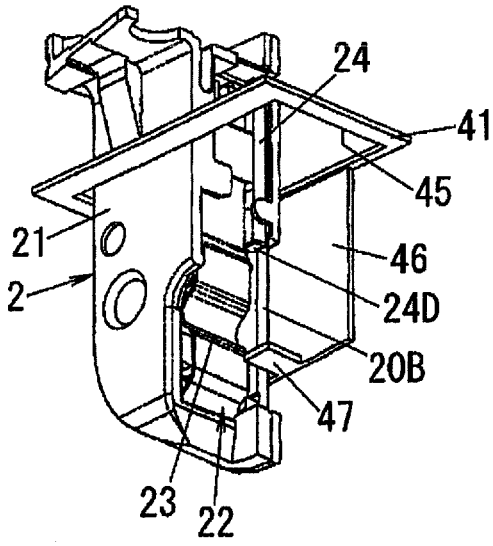
Figure 6C:
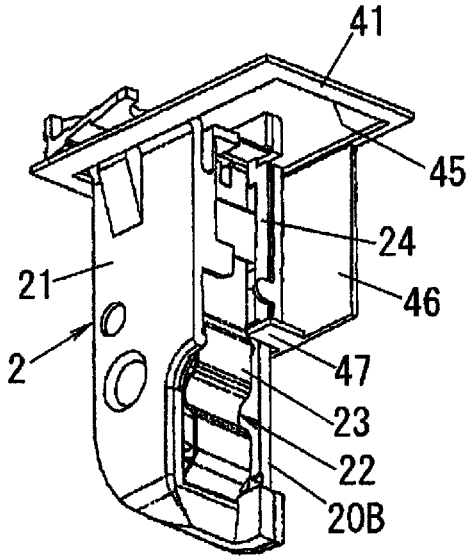

A method of attaching the earth socket 2 to the attachment base 41 in a snap-in fashion will now be described with reference to FIGS. 5 and 6. In FIGS. 6A through 6C, the right half of the earth socket 2 is removed in order to make readily understandable the contact between the jut portion 47 and the protuberance 24D of the connecting piece 24. As shown in FIGS. 5A and 6A, the lower end portion of the earth socket 2 is first inserted into the rectangular hole 45 of the attachment base 41 from above. Then, as shown in FIGS. 5B and 6B, the jut portion 47 of the attachment base 41 is inserted into the slit 20B of the earth socket 2. Subsequently, the earth socket 2 is forcibly pushed downward so that the outer peripheral edge of the rectangular hole 45 of the attachment base 41 can be gripped between the elastic pieces 21B and the lug portions 21C. Consequently, the earth socket 2 is attached to the attachment base 41. At this time, as shown in FIGS. 5C and 6C, the protuberance 24D of the conductor plate 22 is pressed against the jut portion 47 inserted into the slit 20B, whereby the salient portion 44 comes into contact with the conductor plate 22. In other words, upon attaching the earth socket 2 to the attachment base 41, the conductor plate 22 of the earth socket 2 is earth-connected to the apparatus body 4.

In case of the snap-in attachment described above, the conductor plate 22 of the earth socket 2 can be easily earth-connected to the apparatus body 4 with no use of lead wires by merely attaching the earth socket 2 to the attachment base 41 of the apparatus body 4.

Second Embodiment

Next, a lighting apparatus according to a second embodiment of the present invention will be described with reference to the drawings. In the following description, the up-down direction, the left-right direction and the front-rear direction will be defined by arrows shown in FIG. 7A. The basic configuration of the present embodiment is common to the configuration of the first embodiment. Common portions will be designated by like reference symbols and redundant description thereof will be omitted.

Figure 7A:
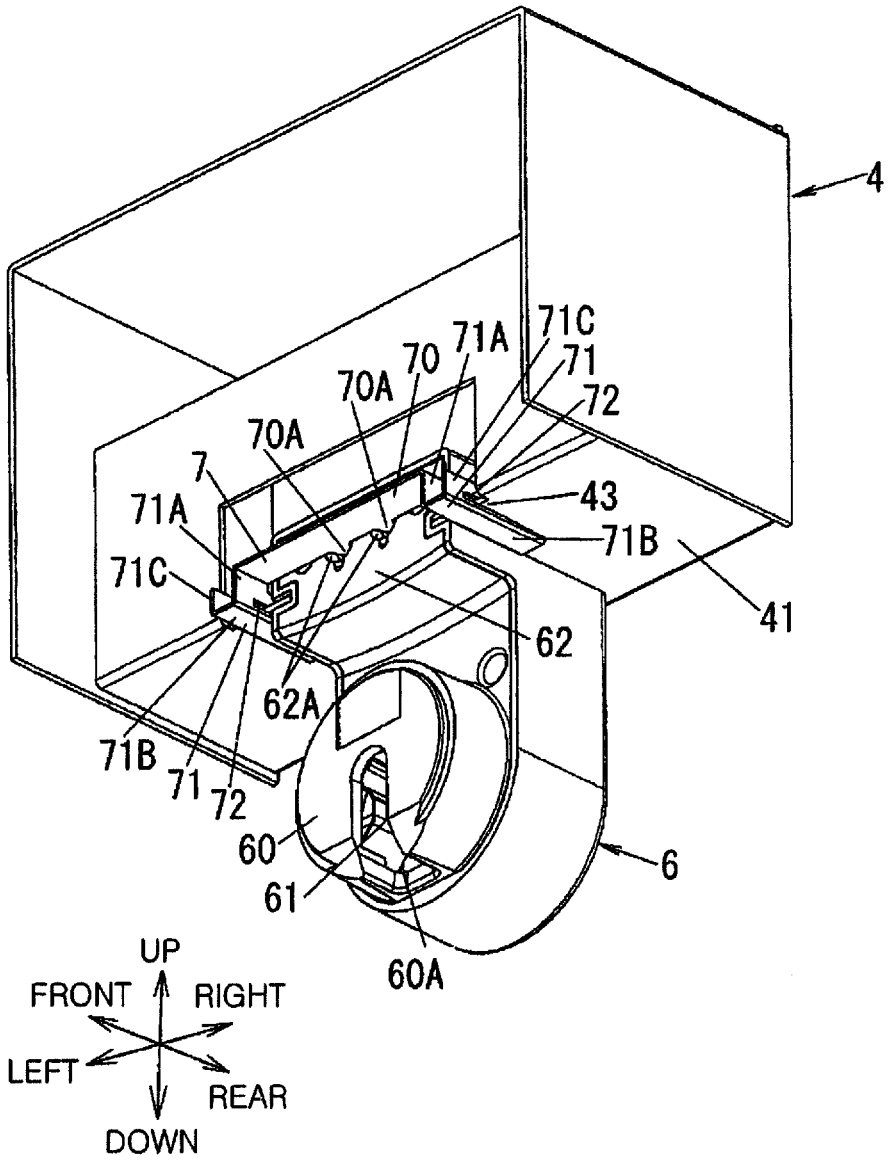
FIG. 7A is a perspective view of certain major portions of a lighting apparatus according to a second embodiment of the present invention and FIG. 7B is a perspective view of a connecting member.
Figure 7B:
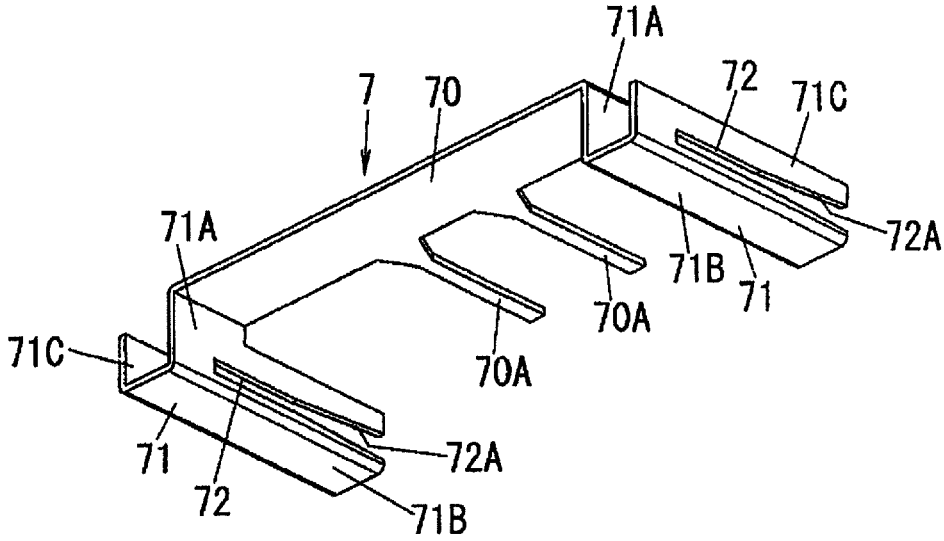

As shown in FIGS. 7A and 7B, the lighting apparatus of the present embodiment includes an earth socket 6 and a connecting member (connecting unit) 7 attached to the earth socket 6 and the attachment base 41 of the apparatus body 4 to electrically interconnect the conductor plate 61 of the earth socket 6 and the apparatus body 4. The earth socket 6 is well-known in the art and no description will be made on the portions of the earth socket 6 having nothing to do with the present invention. The power feeding socket has the same structure as the earth socket 2. Therefore, the power feeding socket will not be shown and described herein.

Figure 8:
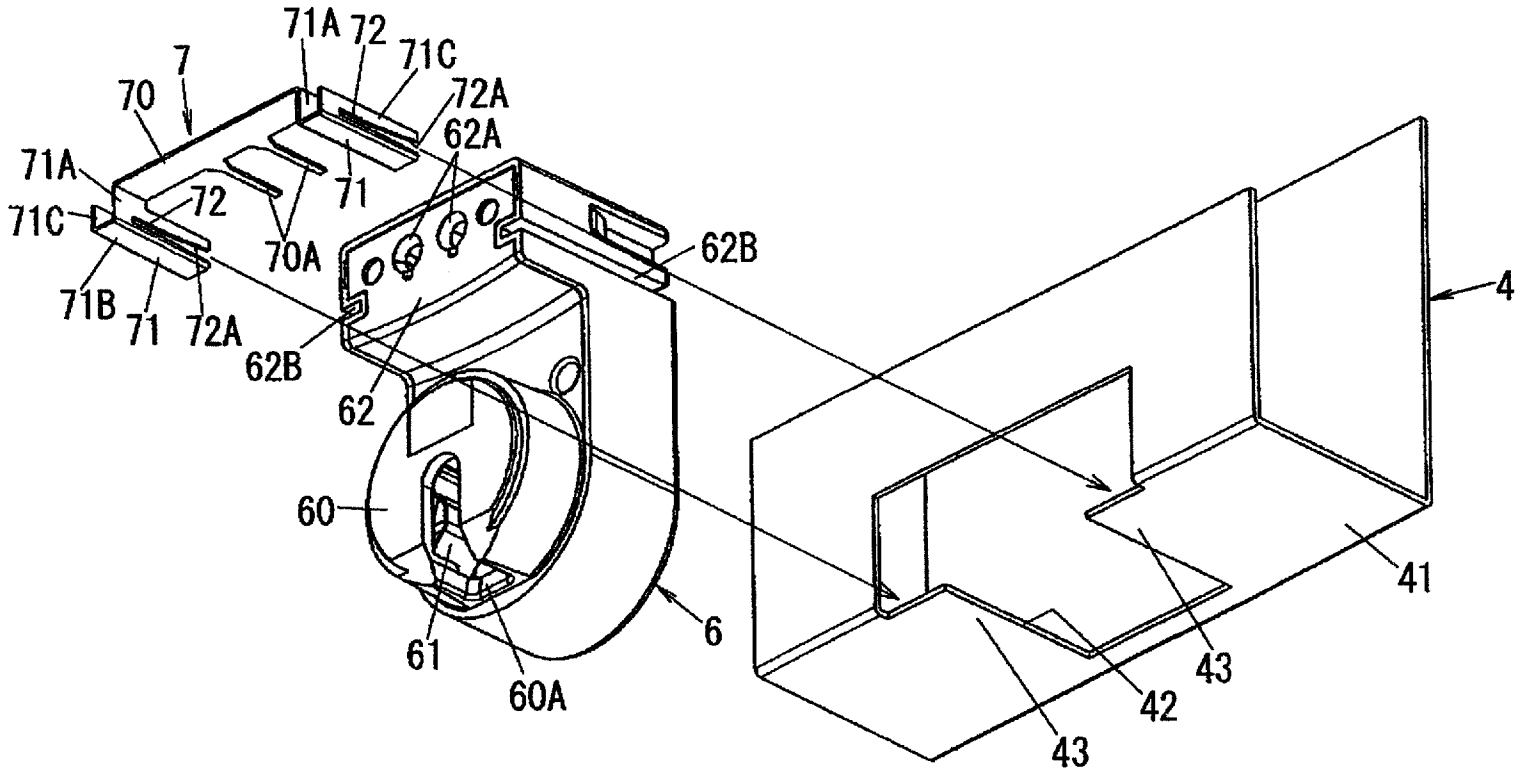
FIG. 8 is a perspective view illustrating a method of attaching an earth socket to an apparatus body in the lighting apparatus.

Just like the earth socket 2 of the first embodiment, the earth socket 6 is made of a resin. As shown in FIG. 8, a rotor 60 to which a lamp pin is connected is rotatably installed on the front surface of the earth socket 6. An insertion recess 60A, opened at the lower and front sides, is formed in the lower end portion of the rotor 60. The lamp pin of the earth cap 12 of the LED lamp 1 can be slidably inserted into the insertion recess 60A. A conductor plate 61 for gripping and mechanically holding the lamp pin of the earth cap 12 is provided inside the insertion recess 60A. The conductor plate 61 is electrically connected to the lamp pin of the earth cap 12.

If the lamp pin is inserted into the insertion recess 60A and if the rotor 60 is rotated 90 degrees clockwise or counter-clockwise, the lamp pin is mechanically held by the conductor plate 61 and is electrically connected to the conductor plate 61. The conductor plate 61 includes a pair of contact pieces similar to the contact pieces 23 of the conductor plate 22 shown in FIG. 4A. The conductor plate 61 is well-known in the art and therefore will not be described herein.

The upper end portion of the earth socket 6 serves as a base portion 62 protruding forward beyond the front surface of the rotor 60. Attachment grooves 62B extending in the front-rear direction are formed in the left and right end portions of the base portion 62. The attachment pieces 43 of the attachment base 41 are slidably inserted into the attachment grooves 62B. On the front surface of the base portion 62, there are provided a pair of circular wire insertion holes 62A for reception of one ends of lead wires (not shown). A pair of terminal portions (not shown) each having a quick-connection terminal structure is arranged within the earth socket 6. The terminal portions are one-piece formed with the conductor plate 61 in such a fashion as to correspond to the wire insertion holes 62A. The quick-connection terminal structure of each of the terminal portions is similar to the quick-connection terminal structure of each of the terminal portions 23A shown in FIG. 4A. The quick-connection terminal structure is well-known in the art and therefore will not be shown and described herein.

Conventionally, lead wires can be connected to the respective terminal portions of the conductor plate by inserting one ends of the lead wires into the wire insertion holes 62A. In the present embodiment, instead of the lead wires, the below-mentioned insertion pieces 70A of the connecting member 7 are inserted into the wire insertion holes 62A, whereby the insertion pieces 70A are mechanically held by the terminal portions of the conductor plate 61 and are electrically connected to the conductor plate 61.

The connecting member 7 is formed by processing an electrically conductive sheet metal such as copper alloy or stainless steel. As shown in FIG. 7B, the connecting member includes a rectangular main piece 70 extending in the left-right direction and a pair of side pieces 71 provided in the left and right end portions of the main piece 70. A pair of elongated flat insertion pieces 70A protruding backward is one-piece formed with the rear edge of the main piece 70 at a central portion thereof in the left-right direction. The insertion pieces 70A are formed in such a size that the insertion pieces 70A can be inserted into the wire insertion holes 62A of the earth socket 6.

As shown in FIG. 7B, each of the side pieces 71 includes a first extension piece 71A protruding downward from one lateral end of the main piece 70 and a second extension piece 71B protruding outward in the left-right direction from the lower end portion of the first extension piece 71A. Each of the side pieces 71 further includes a third extension piece 71C protruding upward from one lateral end of the second extension piece 71B. Each of the first extension piece 71A and the third extension piece 71C has an insertion slot 72 opened at the rear end thereof. Each of the attachment pieces 43 of the attachment base 41 is slidably inserted into the insertion slot 72. The up-down width of the insertion slot 72 is set a little smaller than the up-down thickness of each of the attachment pieces 43. A taper portion 72A having an up-down width gradually increasing toward the opening is formed in the rear end portion of the insertion slot 72. Each of the attachment pieces 43 is guided into the insertion slot 72 along the taper portion 72A.

Description will now be made on a method of attaching the earth socket 6 and the connecting member 7 to the attachment base 41 of the apparatus body 4. As shown in FIG. 8, the attachment pieces 43 of the attachment base 41 are first aligned with the attachment grooves 62B of the earth socket 6 and then the earth socket 6 is slid backward. As a result, the attachment pieces 43 are fitted to the attachment grooves 62B, whereby the earth socket 6 is attached to the attachment base 41. Next, the insertion pieces 70A of the connecting member 7 are inserted into the wire insertion holes 62A of the earth socket 6 and then the connecting member 7 is slid backward.

At this time, the connecting member 7 is mechanically held by the attachment base 41 as the attachment pieces 43 are inserted and fitted to the insertion slots 72 of the connecting member 7. Since the attachment pieces 43 make contact with the inner edges of the insertion slots 72, the connecting member 7 and the apparatus body 4 are electrically connected to each other. At the same time, the insertion pieces 70A are mechanically held by the respective terminal portions of the conductor plate 61 existing within the earth socket 6 and are electrically connected to the conductor plate 61. In other words, the connecting member 7 is attached to the attachment base 41 and the conductor plate 61 of the earth socket 6 is earth-connected to the apparatus body 4 through the connecting member 7.

In the present embodiment described above, the connecting member 7 is attached to the earth socket 6 and the attachment base 41 in a state that the earth socket 6 is attached to the attachment base 41 of the apparatus body 4. Consequently, the conductor plate 61 of the earth socket 6 is earth-connected to the apparatus body 4 through the connecting member 7. In the present embodiment, therefore, the conductor plate 61 of the earth socket 6 can be easily earth-connected to the apparatus body 4 with no use of lead wires by merely attaching the earth socket 6 and the connecting member 7 to the attachment base 41 of the apparatus body 4. Since it is not necessary to use the lead wire 103 employed in the conventional example, there is no need to form the crimp-type terminal 103A in the lead wire 103. This makes it possible to reduce the costs. Since the earth socket 6 is gripped between the connecting member 7 and the attachment base 41, it is possible to prevent the earth socket 6 from dropping from the attachment base 41.

The connecting member 7 is mechanically held by the earth socket 6 as the insertion pieces 70A are locked to the respective terminal portions of the conductor plate 61 of the earth socket 6. The earth socket 6 may be attached to the attachment base 41 in a state that the connecting member 7 is attached to the earth socket 6 in advance. This makes it possible to easily perform the assembling work.

Figure 9A:
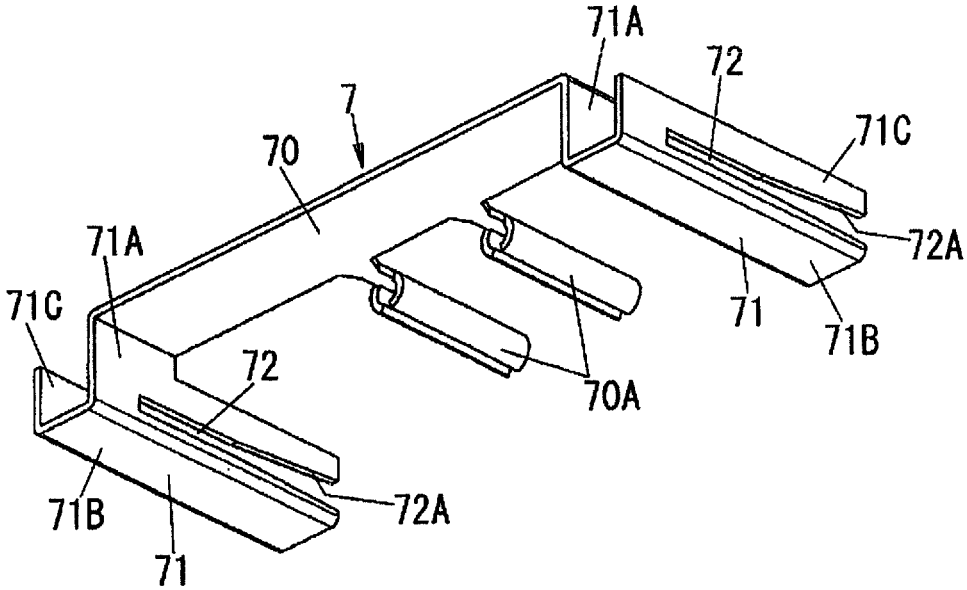
FIGS. 9A and 9B are perspective views showing different examples of an insertion portion of the connecting member of the lighting apparatus.
Figure 9B:
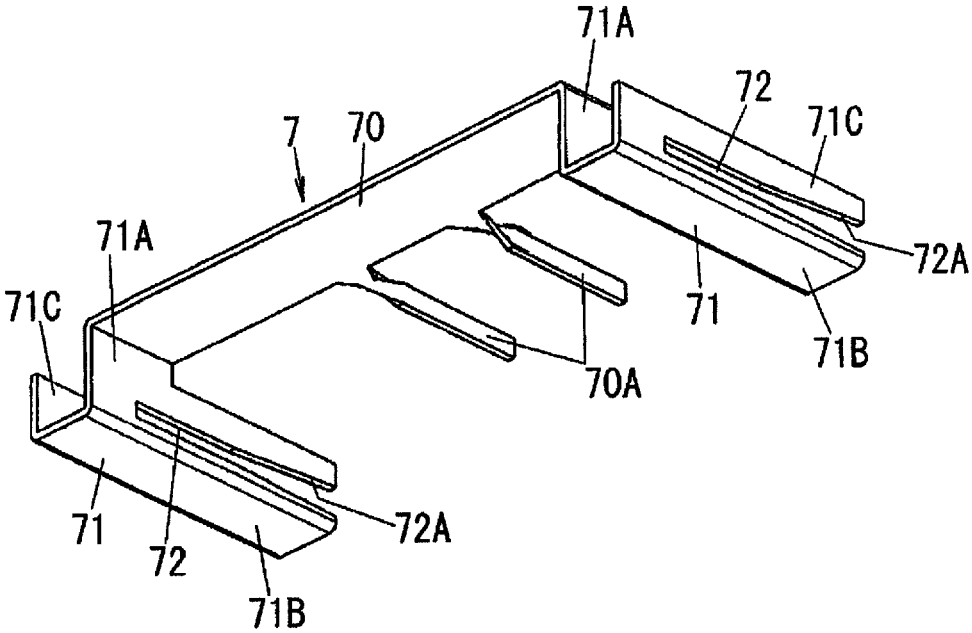

As shown in FIG. 9A, each of the insertion pieces 70A of the connecting member 7 may be formed into a cylindrical shape to have such a diameter that the insertion pieces 70A can be inserted into the wire insertion holes 62A. In this case, the insertion pieces 70A are stably held by the terminal portions of the conductor plate 61. This helps stabilize the electric connection between the connecting member 7 and the conductor plate 61. As shown in FIG. 9B, the insertion pieces 70A may be twisted 90 degrees clockwise or counterclockwise with respect to the base portions thereof. In this case, the insertion pieces 70A are reliably locked by the terminal portions of the conductor plate 61. This further stabilizes the electric connection between the connecting member 7 and the conductor plate 61.

Figure 10A:
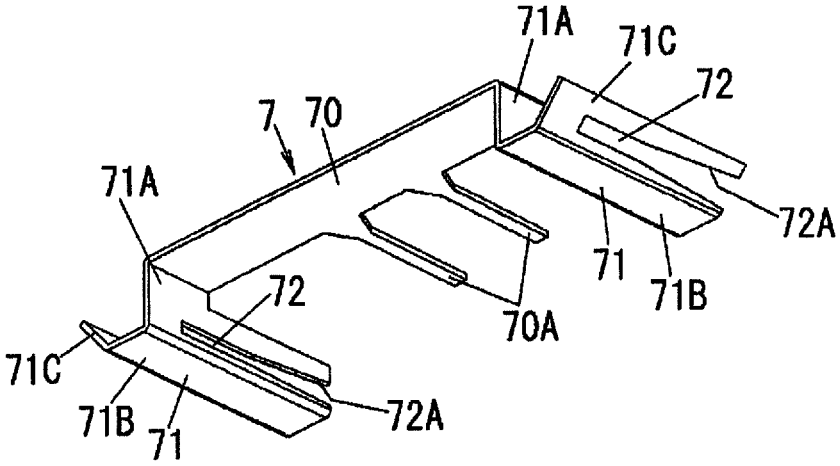
FIG. 10A is a perspective view showing another example of side pieces of the connecting member of the lighting apparatus.
Figure 10B:
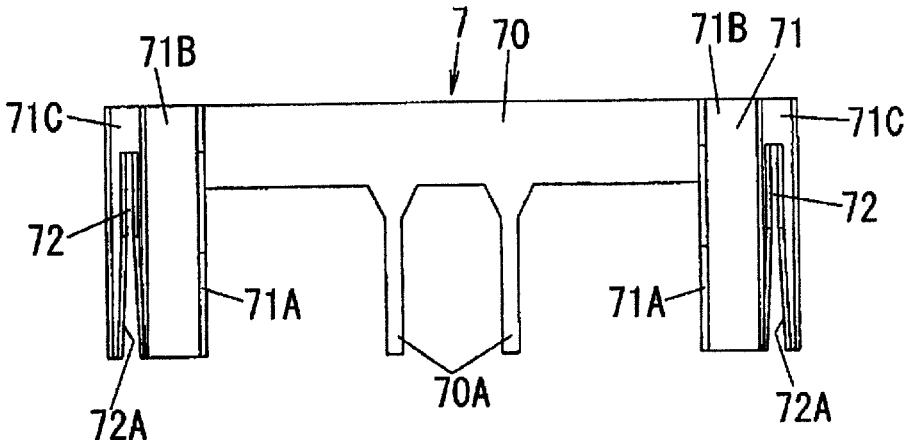
FIG. 10B is a plan view thereof.
Figure 10C:
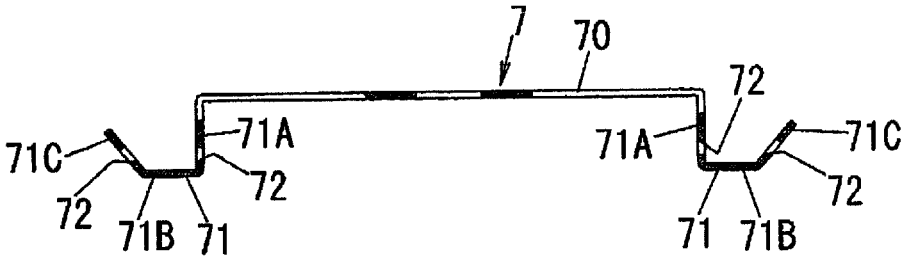
FIG. 10C is a section view thereof and FIG. 10D is a partial section view of the connecting member attached to the apparatus body.
Figure 10D:
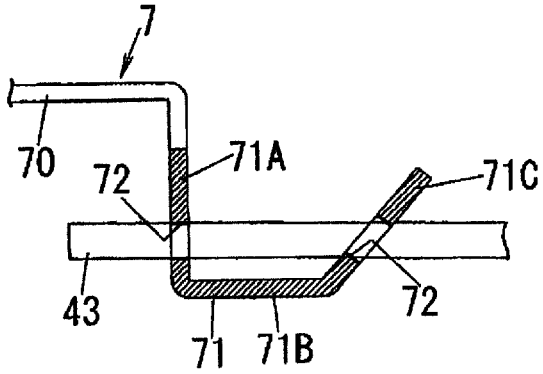

As shown in FIGS. 10A through 10C, the third extension piece 71C of each of the side pieces 71 may be inclined to extend outward in the left-right direction. In this case, if the connecting member 7 is attached to the attachment base 41, the inner peripheral edge of the insertion slot 72 of the third extension piece 71C cuts into each of the attachment pieces 43 as shown in FIG. 10D. Consequently, even if the attachment base 41 is coated with paint, the connecting member 7 can be brought into contact with the metal area of the attachment base 41. This further stabilizes the electric connection between the connecting member 7 and the apparatus body 4.

Figure 11:
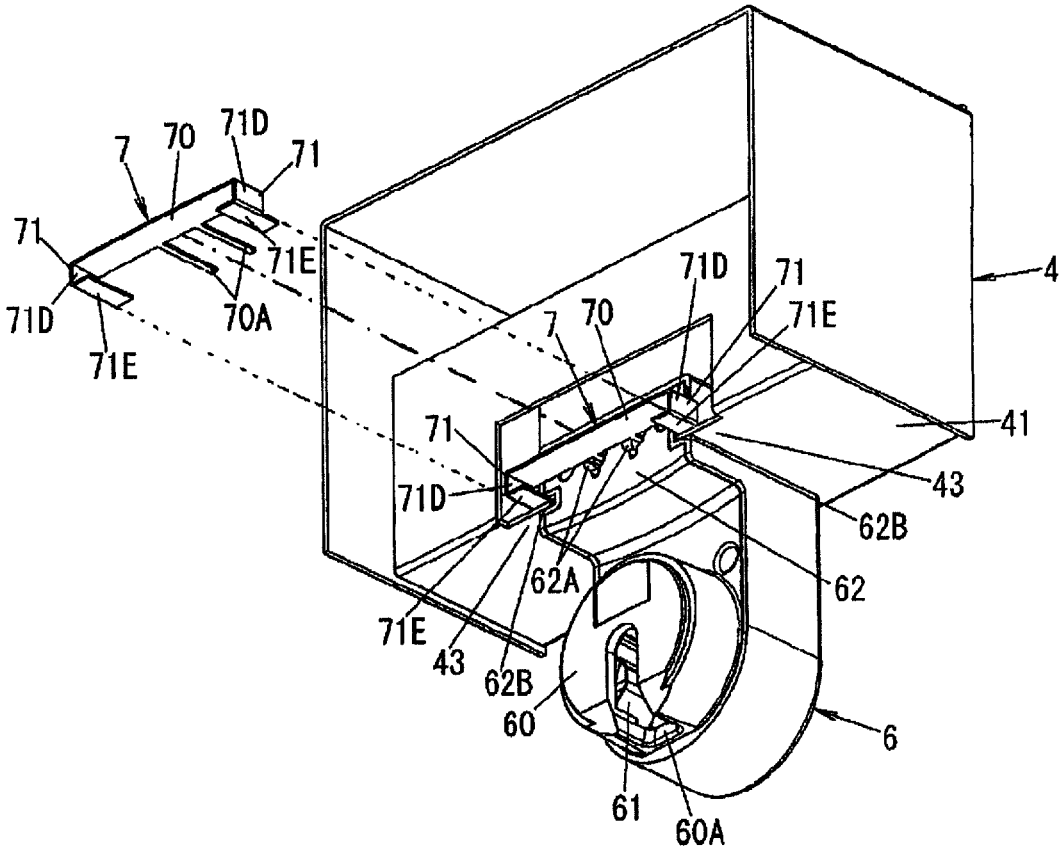
FIG. 11 is a perspective view showing a further example of the side pieces of the connecting member of the lighting apparatus.
Figure 12:
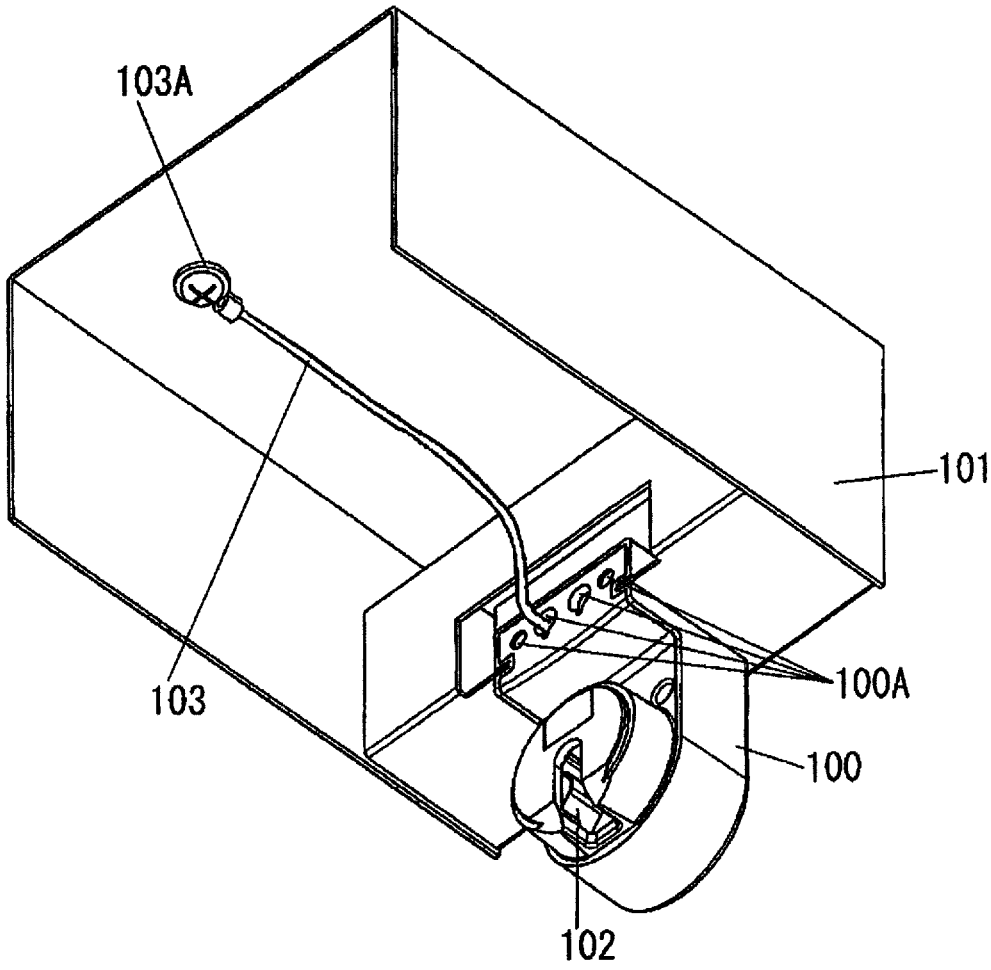
FIG. 12 is a schematic view showing a conventional lighting apparatus in which an earth socket is earth-connected to an apparatus body.

In the embodiment described above, the connecting member 7 is attached to the attachment base 41 by fitting the attachment pieces 43 to the insertion slots 72 of the connecting member 7. Alternatively, the connecting member 7 may be partially inserted into the attachment grooves 62B. In this configuration, as shown in FIG. 11, each of the side pieces 71 includes a fourth extension piece 71D protruding downward from one lateral end portion of the main piece 70 and a fifth extension piece 71E protruding inward along the left-right direction from the lower end portion of the fourth extension piece 71D. The front-rear dimension of the fifth extension piece 71E is set larger than the front-rear dimension of the fourth extension piece 71D.

Accordingly, if the insertion pieces 70A of the connecting member 7 are inserted into the wire insertion holes 62A of the earth socket 6 in a state that the earth socket 6 is attached to the attachment base 41, the fifth extension piece 71E is gripped between the inner edges of the attachment grooves 62B and the attachment pieces 43. Since the fifth extension piece 71E makes contact with the attachment pieces 43, the connecting member 7 and the apparatus body 4 are electrically connected to each other.

While the invention has been shown and described with respect to the embodiments, it will be understood by those skilled in the art that various changes and modification may be made without departing from the scope of the invention as defined in the following claims.

What is claimed is:

1. A lighting apparatus, comprising:

an apparatus body for supporting an LED lamp having an earth cap;

an earth socket to which the earth cap of the LED lamp is mounted; and an attachment base provided in the apparatus body, the earth socket being attached to the attachment base, wherein the earth socket includes an earth conductor plate for mechanically holding a lamp pin of the earth cap, the conductor plate being electrically connected to the lamp pin, and the attachment base and the earth socket include a connecting unit for earth-connecting the conductor plate of the earth socket and the apparatus body;

wherein the connecting unit includes an insertion hole formed in the earth socket and a salient portion provided at the attachment base and inserted into the insertion hole, the salient portion making contact with the conductor plate through the insertion hole when the earth socket is attached to the attachment base.

2. The apparatus of claim 1, wherein the conductor plate has a hole portion for reception of the salient portion, the salient portion making contact with an inner peripheral surface of the hole portion.

3. The apparatus of claim 2, wherein erected pieces are formed in an inner edge of the hole portion, the elected pieces protruding in a protruding direction of the salient portion, the elected pieces being inclined toward the salient portion inserted into the hole portion.

4. The apparatus of claim 1, wherein the salient portion is bendable.

5. The apparatus of claim 4, wherein the conductor plate has a hole portion for reception of the salient portion, the salient portion making contact with an inner peripheral surface of the hole portion.

6. The apparatus of claim 5, wherein erected pieces are formed in an inner edge of the hole portion, the elected pieces protruding in a protruding direction of the salient portion, the elected pieces being inclined toward the salient portion inserted into the hole portion.

7. A lighting apparatus, comprising:

an apparatus body for supporting an LED lamp having an earth cap;

an earth socket to which the earth cap of the LED lamp is mounted; and an attachment base provided in the apparatus body, the earth socket being attached to the attachment base, wherein the earth socket includes an earth conductor plate for mechanically holding a lamp pin of the earth cap, the conductor plate being electrically connected to the lamp pin, and the attachment base and the earth socket include a connecting unit for earth-connecting the conductor plate of the earth socket and the apparatus body;

wherein the connecting unit includes a connecting member attached to the earth socket and the attachment base and electrically connected to the conductor plate of the earth socket and the attachment base; the connecting member is an electrically conductive material.

8. The apparatus of claim 7, wherein the connecting member includes an insertion slot into which the attachment base is partially inserted, the attachment base having a portion making contact with an inner edge of the insertion slot.

9. The apparatus of claim 7, wherein the earth socket includes an insertion hole, the conductor plate including a terminal portion of a quick-connection terminal structure arranged to correspond to the insertion hole, the connecting member including an insertion piece inserted into the insertion hole, the insertion piece being mechanically held by the terminal portion and electrically connected to the terminal portion.

10. The apparatus of claim 9, wherein the connecting member includes an insertion slot into which the attachment base is partially inserted, the attachment base having a portion making contact with an inner edge of the insertion slot.

* * * * *